United States Patent [19]

Ozawa

[11] Patent Number: 4,757,904

[45] Date of Patent: Jul. 19, 1988

[54] APPARATUS FOR TRANSPORTING SHEETS

[75] Inventor: Satoshi Ozawa, Kawasaki, Japan

[73] Assignee: Kabushiki Kaisha Toshiba, Kawasaki, Japan

[21] Appl. No.: 903,455

[22] Filed: Sep. 4, 1986

[30] Foreign Application Priority Data

Sep. 5, 1985 [JP] Japan ..... 60-194906
Jul. 24, 1986 [JP] Japan ..... 61-172751

[51] Int. Cl.[4] ..... B07C 5/02

[52] U.S. Cl. ..... 209/540; 209/900; 271/3.1; 271/291; 271/301; 271/262

[58] Field of Search ..... 271/3.1, 291, 301, 262, 271/259; 209/540, 900

[56] References Cited

U.S. PATENT DOCUMENTS 3,938,435 2/1976 Suda et al. ..... 101/2
4,192,607 3/1980 Hage ..... 271/291 X
4,200,386 4/1980 Queener ..... 271/291 X
4,229,100 10/1980 Travis ..... 271/291 X
4,231,567 11/1980 Ziehm ..... 271/259
4,344,614 8/1982 Kaneko ..... 271/259 X
4,449,813 5/1984 Kikuchi ..... 271/259 X
4,570,801 2/1986 Brannen ..... 271/262 X
4,573,673 3/1986 Haug ..... 271/259 X

FOREIGN PATENT DOCUMENTS 0134996 3/1985 European Pat. Off. .

*Primary Examiner*—Richard A. Schacher
*Attorney, Agent, or Firm*—Cushman, Darby & Cushman

[57] ABSTRACT

An apparatus for transporting a postal matter comprises a main transporter for transporting the matter one by one and first and second auxiliary transporters extending form the feed-out end of the main transporter. The first auxiliary transporter have a feed-out end thereof connected to the feed-in end of the main transporter. A gate is provided between the main and auxiliary transporters to selectively connect the main transporter one of the first and second auxiliary transporters, and a stamper is provided on the second auxiliary transporter for stamping supplied postal matter. The apparatus is stopped when jamming of postal matter occurs in the transporters and the gate causes the main transporter and first auxiliary transporters to be held connected for a predetermined period of time at the time of resuming the operation of the apparatus after removal of the jamming.

11 Claims, 1 Drawing Sheet

APPARATUS FOR TRANSPORTING SHEETS

BACKGROUND OF THE INVENTION

This invention relates to an apparatus for transporting sheets for use in, for instance, a postal matter handling apparatus for stamping postal matter with postage stamp provided thereon and sorting the stamped postal matter.

As a prior art apparatus for sheet transporting, there has been known the following postal matter rearranging/stamping apparatus. Postal matter, which is taken out one by one from a supply section is transported in an upright state along a transporter to reach a detector provided thereon. The detector checks for the object of detection, e.g., postage stamp, on the front or back side of postal matter. When stamp is detected to be on a lower portion of postal matter with respect to a reference surface of transport, that postal matter is supplied in the same state, i.e., without inversion, along non-inversion transporter to a stamper. When stamp is detected to be in the other, i.e., upper, portion of postal matter, that postal matter is supplied through an inversion transported to the stamper. The postal matter supplied to the stamper is stamped by the stamper before being collected in a stacker.

When jamming of sheets occurs on the transporter, the apparatus is stopped, and the jammed sheets are removed before resuming the operation of the apparatus. At the time of the resumption, it is necessary to reject all the postal matter remaining on the transporter into a reject stacker in order to prevent erroneous sorting of postal matter. If it is intended to effect sorting without rejecting the remaining postal matter into the stacker at this time, difficulties are encountered in the processing of shift data. In addition, there is considerable possibility of occurrence of erroneous sorting.

SUMMARY OF THE INVENTION

An object of the invention is to provide an apparatus for transporting sheets, which can reduce erroneous sorting of sheets remaining on the transporter or rejected sheets at the time of resuming operation of the apparatus after removal of jammed sheets.

DETAIL DESCRIPTION OF THE PREFERRED EMBODIMENTS

Figure 1:
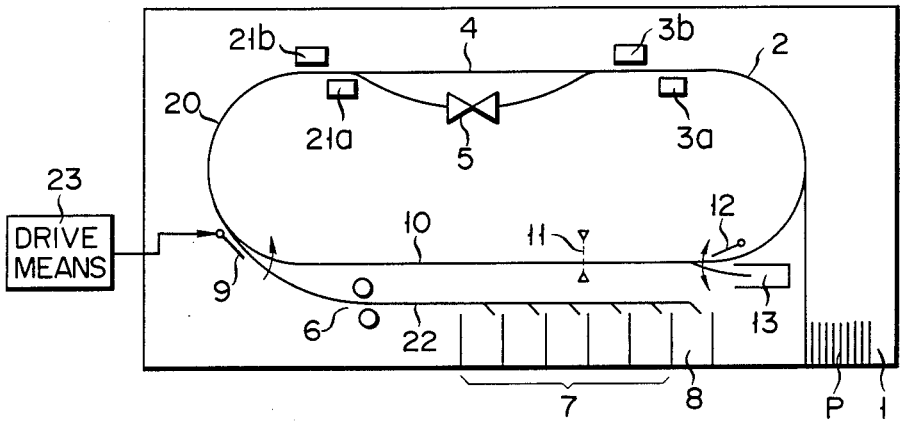
FIG. 1 is a schematic plan view showing an embodiment of the invention.

Now, an invention will be described in conjunction with an embodiment thereof shown in FIG. 1. Referring to the Figure, reference numeral 1 designates a supply section for supplying sheets, i.e., postal matter P, in an upright state. The postal matter supplied to the supply section is taken out and supplied one by one to first transporter means 2 by a one-by-one take-out/supply mechanism.

First transporter means 2 is provided with first detector means 3*a*, 3*b* for detecting an object, i.e., postage stamp, provided on a lower portion of the front side or back side of postal patter P. The detector means consist of a light-emitting element and a light-receiving element for receiving light emitted from the light-emitting element and then reflected by the postal matter. When stamp is detected by the detector means, the postal matter is transported in the same orientation to non-inversion transporter means 4. When no stamp is detected, the postal matter is transported to inversion transporter means 5. Transporter means 4 and 5 are connected to common transporter means 20. The postal matter P transported to non-inversion transporter means 4 is transported in the same orientation, i.e., without reversal, to common transporter means, while postal matter P supplied to inversion transporter means 5 is inverted upside down and transported to common transporter means 20. Common or second transporter means 20 is provided with second detector means 21*a* and 21*b* for detecting stamp provided on a lower portion of the postal matter. When no stamp is detected even by these detector means, it is determined that the checked postal matter has no stamp at all or may have stamp which is not applied to a predetermined position. Common transporter means 20, non-inversion transporter means 4 and inversion transporter means 5 constitute second transporter means. First and second auxiliary transporter means 10 and 22 are connected to the downstream end of the common transporter means. At the junction between these transporter means, there is provided first gate 9 which selectively distributes the postal matter from common transporter means 20 in the same orientation first and second auxiliary transporter means 10 and 22. First gate 9 can be driven to assume a first position, at which the first gate is normally held to guide postal matter to the second auxiliary transporter means, and a second position, at which the gate is held for a predetermined period of time after re-start to guide postal matter to the first auxiliary transporter means. Gate drive mechanism 23 is interlocked to a start switch of the apparatus, and it is driven to the second position when the start switch is closed. Stamper means 6, stacker means 7 to collect stamped postal matter and first reject stacker 8 to collect reject postal matter are provided along the second auxiliary transporter means 22. Stamper means 6 has a well-known construction, for stamping the postal matter supplied from the second auxiliary transporter means at the position where the stamp is applied. Stackers 7 and 8 selectively collect and hold the supplied postal matter according to the content thereof.

First auxiliary transporter means 10 is provided with detector 11, which can detect a reduced pitch interval, than a predetermined pitch, of postal matter transported to the first auxiliary transporter means when the apparatus is restarted after removal of jamming and also detect postal matter P being transported in an inclined state. Second gate 12 is provided to supply postal matter P having been detected by detector 11 from first auxiliary transporter means 10 to second reject stacker 13. When the apparatus is re-started, postal matter P remaining upstream first gate 9 and on third transporter means 10 is accelerated to join first transporter means 2 right before detector means 3*a* and 3*b* such that a constant transport speed is obtained until detector means 3*a* and 3*b* is reached.

Now, the operation of the apparatus according to the invention will be described. Postal matter P supplied to supply section 1 is taken out one by one by the one-by-one take-out/supply mechanism (not shown) to be fed to and transported along first transporter means 2. When postal matter P proceeds past detectors 3*a* and 3*b*, detector 3*a* detects stamp as object of detection applied to the front side of postal matter P, while other detector 3*b* detects stamp applied to the back side of postal matter P. Postal matter P with stamp applied in a lower portion with respect to a reference plane of transport is supplied in the same orientation, i.e., without inversion, to non-inversion transporter means 4. Postal matter P with stamp applied to the other, i.e., upper, portion is supplied to inversion transporter means 5.

Postal matter P, which is supplied from noninversion and inversion transporter means 4 and 5 to common transporter means 20 and with stamp positioned on the lower portion, is transported through first gate 9 to stamper 6 for stamping. Stamped postal matter P is distributedly collected in individual stackers 7.

When jamming of postal matter P occurs on either transporter means 2, 4, 5 or 20, first gate 9 is driven in the direction of arrow to the second position to direct postal matter P to first auxiliary transporter means 10. At the same time, the driving of transporter means is stopped. The operator removes jammed postal matter P from transporter means, and the apparatus is re-started. At this time, the one-by-one take-out/supply mechanism in supply section 1 is not immediately started. Therefore, postal matter P remaining on the transporter subsequent to first gate 9 is collected in reject stacker 8. On the other hand, postal matter P remaining on transporter path ahead of first gate 9 and also on first auxiliary transporter means 10 join together at a position right before the first detector before being transported at a constant speed along first transporter means to the detector.

Postal matter P remaining on first transporter means ahead of first gate 9 is thus proceeds past detectors 3*a*, 3*b* for stamp detection, then stamped in stamper 6 and then classifiedly stamped in stackers 7. Thus, all postal matter P remaining on transporter at least ahead of the first gate is not collected in reject stacker 13. It is thus possible to reduce the quantity of the reject stacker.

When there occurs defective transport of postal matter P when detector 11 provided on first auxiliary transporter 10 is re-started, that is, when the pitch interval of transport of postal matter P is reduced from a predetermined pitch or when inclined postal mater P is detected, second gate 12 is rotated in the direction of arrow to collect postal matter P in second reject stacker 13. Thus, of postal matter P remaining on first auxiliary transporter 10 that which is in the normal transport state is not collected in second reject stacker 13 but is transported again.

Figure 2:
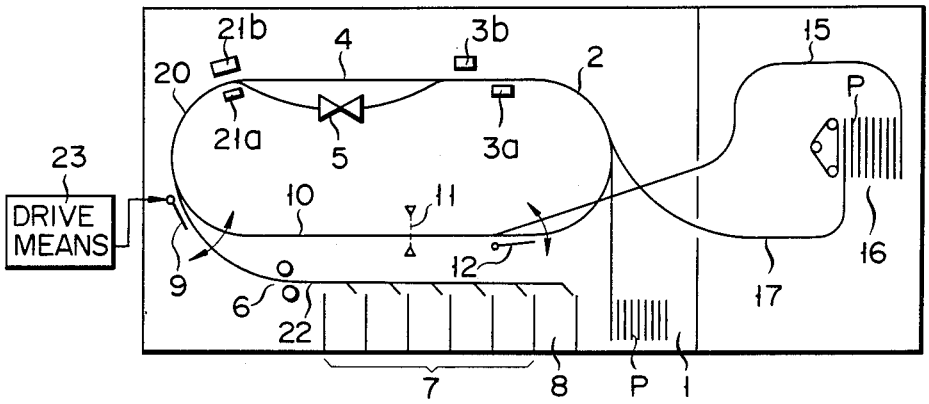
FIG. 2 is a schematic plan view showing a different embodiment of the invention.

FIG. 2 shows a second embodiment of the invention. In the Figure, parts like those shown in FIG. 1 are designated by like reference numerals, and their description is omitted. Reference numeral 15 in the Figure designates a third auxiliary transporter, which branches form third transporter 10 and has the role of second reject stacker 13 shown in FIG. 1. The downstream end of third auxiliary transporter 15 is provided with second supply section 16 for re-supply defective transport postal matter P having been transported from first auxiliary transporter 10 to fifth transporter 15. Like first supply section, 1 second supply section 16 is provided on the take-out side with a one-by-one take-out/supply section (not shown). Further, fourth auxiliary transporter 17 is provided to supply taken-out postal matter P to first transporter 2.

With this construction, when jamming of postal matter P occurs on transporter, first gate 9 provided at the branching point is switched to a position to guide postal matter P to first auxiliary transporter 10. At the same time, the driving of transporter is stopped. After removal of jammed postal matter by the operator, the transporter is re-started with remaining postal matter P on it as in the preceding embodiment. At this time, the one-by-one take-out/supply section in supply section 1 is not immediately started. With the start of the transporter, postal matter P remaining on portion of the transporter subsequent to second auxiliary transporter 22 is collected in reject stacker 8, while postal matter P remaining on transporter ahead of the second auxiliary transporter proceeds along first auxiliary transporter 10 and joins first transporter 2 at a position immediately ahead of the first detector to be transported along first transporter 2 at a constant speed to first detector.

When there occurs detective transport, e.g., when the pitch of postal patter P remaining on first auxiliary transporter 10 is reduced or when the postal matter is inclined, detector 11 provided on first auxiliary transporter 10 detects defective transport postal matter P and causes second gate 12 to be rotated in the counterclockwise direction. Postal matter P thus is guided from third transporter 10 to third auxiliary transporter 15 to be supplied to second supply section 16. The one-by-one take-out/supply mechanism (not shown) provided on the take-out side of second supply section 16 is controlled such that the re-start is caused at an instant when the take-out of postal matter P by first supply section 1 has been completed. Therefore, postal matter P taken out from second supply section 16 is supplied through fourth auxiliary transporter 17 to first transporter 2, so that it proceeds past detector 3*a*, 3*b*, again to be classifiedly collected in stackers 7.

In the above embodiments, detector and inversion transporter are provided. However, they may be omitted. Further, the first and second supply sections may be replaced with buffer stacker feeders which are used well-known postal matter rearranger/stampers. Further, the non-inversion transporter provided as third transporter means 10 may be replaced with switch-back means.

Further, while the above embodiments have used the optical detector, this is by no means limitative.

As has been described in the foregoing, according to the invention at the time of occurrence of jamming of sheets on either main transporter means or first auxiliary transporter means, sheets are supplied to main transporter means through second auxiliary transporter means branching from the main transporter means. Consequently, it is possible to reduce normal status sheets that are collected from the main transporter into reject stacker at the time of the re-start of the transporter.

Thus, normal status sheets that have heretofore been collected in the reject stacker at such occasion, need not be supplied again to the transporter, so that it is possible to reduce the operational efficiency of the processing of sheets.

What is claimed is:

1. An apparatus for transporting sheets comprising:

main transporter means for transporting sheets having information thereon, one by one, including a feed-in end and a feed-out end;

first and second auxiliary transporter means, extending from the feed-out end of said main transporter means, said first auxiliary transporter means having a feed-out end thereof connected to the feed-in end of said main transporter means;

gate means provided between said main and auxiliary transporter means to selectively connect said main transporter means to one of said first and second auxiliary transporter means, the gate means normally connecting the main transporter means to the second auxilary transporter means;

processing means provided on said second auxiliary transporter means for processing supplied sheets;

drive means for stopping said apparatus when jamming of sheet occurs in said main transporter means, and driving said gate means to cause said main transporter means and first auxiliary transporter means to be held connected for a predetermined period of time at the time of resuming the operation of the apparatus after removal of the jamming;

said main transporter means including detector means for checking the information on said sheets passing along said main transporter means.

2. The apparatus according to claim 1, which further comprises means for detecting the state of sheets being transported along said first auxiliary transporter means, and holding means for removing defective sheets from said first auxiliary transporter means and holding the removed sheets according to a result of detection by said detecting means.

3. The apparatus according to claim 2, wherein said holding means includes a stacker and separate gate means provided on said first auxiliary transporter means for selectively supplying sheets passing there along to said stacker.

4. The apparatus according to claim 3, wherein said holding means includes separate supply means, third auxiliary transporter means connected between the feed-in end of said separate supply means and said first auxiliary transporter means, fourth auxiliary transporter means connected between the feed-out end of said separate supply means and the feed-in end of said main transporter means, and said separate gate means is provided between said first auxiliary transporter means and thrid auxiliary transporter means for selectively guiding sheets to said third auxiliary transporter means.

5. The apparatus according to claim 1, wherein said processing means includes stamper means for stamping said sheets.

6. The apparatus according to claim 5, further comprising;

a supply section connected to the feed-in end of the main transporter means for supplying said sheets.

7. The apparatus according to claim 5, wherein said detector means checks whether postage which constitutes the information on said sheet is applied to said sheet.

8. An apparatus for transporting sheets comprising:

main transporter means for transporting sheets one by one, including a feed-in end and a feed-out end;

supply means for holding a large number of sheets and feeding sheets one by one to said main transporter means;

first and second auxiliary transporter means extending from the feed-out end of said main transporter means, the feed-out end of said first auxiliary transporter means connected to the feed-in end of said main transporter means; and gate means provided between said main and auxiliary transporter means for connecting said main transporter means and said second auxiliary transporter means when sheets are being supplied from said supply means;

said transporter means being stopped when jamming of sheets occurs therein, said gate means being driven to cause said main transporter means and said first auxiliary transporter means to be held connected for a predetermined period of time at the time during resumption of operation of the apparatus after removal of the jamming, said main and first auxiliary transporter means cooperating so as to transport sheets to the feed-in end of said main transporter means.

9. The apparatus according to claim 8, which further comprises means for detecting the state of sheets being transported along said first auxiliary transporter means, and holding means for removing defective sheets from said transporter means and holding the removed sheets according to a result of detection by said detecting means.

10. The apparatus according to claim 9, wherein said holding means includes a stacker and separate gate means provided on said first auxiliary transporter means for selectively supplying sheets passing there along to said stacker.

11. The apparatus according to claim 10, wherein said holding means includes separate supply means, third auxiliary transporter means connected between the feed-in end of said separate supply means and said first auxiliary transporter means, fourth auxiliary transporter means connected between the feed-out end of said separate supply means and the feed-in end of said main transporter means, and said separate gate means is provided between said first auxiliary transporter means and third auxiliary transporter means for selectively guiding sheets to said third auxiliary transporter means.

* * * * *